United States Patent [19]

Wittes

[11] Patent Number: 4,627,129

[45] Date of Patent: Dec. 9, 1986

[54] SPONGE AND FABRICATION METHOD

[75] Inventor: James M. Wittes, Linden, N.J.

[73] Assignee: Stiefel Laboratories, Inc., Coral Gables, Fla.

[21] Appl. No.: 632,411

[22] Filed: Jul. 19, 1984

[51] Int. Cl.[4] ..... A47L 13/16

[52] U.S. Cl. ..... 15/244 C; 15/118; 15/227

[58] Field of Search ..... 15/244 R, 244 C, 118

[56] References Cited

U.S. PATENT DOCUMENTS

| | | | |
|---|---|---|---|
| 1,577,861 | 3/1926 | Henry | 15/244 C X |
| 2,041,740 | 5/1936 | Beckman . | |
| 2,319,873 | 5/1943 | Linz | 15/244 C |
| 2,350,707 | 6/1944 | Vaughn . | |
| 2,664,581 | 1/1954 | Miller et al. . | |
| 2,841,811 | 7/1958 | Carroll | 15/244 R |
| 2,910,714 | 11/1959 | Becker | 15/244 R |
| 2,961,677 | 11/1960 | Zecchini . | |
| 3,005,219 | 10/1961 | Miller | 15/98 |
| 3,040,353 | 6/1962 | Gray | 15/118 |
| 3,067,450 | 12/1962 | Mirth | 15/118 X |
| 3,112,219 | 11/1963 | Politzer et al. | 117/98 |
| 3,118,163 | 1/1964 | Abberly . | |
| 3,124,822 | 3/1964 | Marchese | 15/118 |
| 3,396,419 | 8/1968 | Richter | 15/104.93 |
| 3,488,126 | 1/1970 | Avallone | 401/8 |
| 3,508,953 | 4/1970 | Simon et al. | 15/244 C |
| 3,611,468 | 10/1971 | Michael | 15/104.93 |
| 4,203,857 | 5/1980 | Dugan | 15/104.93 X |

*Primary Examiner*—Chris K. Moore

*Attorney, Agent, or Firm*—Gregor N. Neff

[57] ABSTRACT

The sponge has a flat washing surface and a round back. It is shaped so as to minimize the bending of the fingers when gripping it, thus facilitating its use by people with arthritic or crippled hands. The sponge also has a notch for a finger to fit into. This makes the sponge easier to grip and control, and allows the application of greater scrubbing pressure to a small area by applying finger pressure against a thin section of sponge material at the end of the notch. This facilitates washing crevices of the body and other difficult-to-reach surfaces. Although the sponge can be used for a wide variety of washing jobs, it is especially useful as a bath sponge. Preferably, the sponge is made of fully-reticulated polyurethane foam, and is formed by compressing a thick sheet of foam against a plate with a shaped hole or cavity in it, and slicing off the protruding mass of material.

7 Claims, 5 Drawing Figures

SPONGE AND FABRICATION METHOD

This invention relates to sponges, and particularly to bath sponges, and to methods of fabricating such sponges.

Many aged or mildly handicapped people who are well enough to at least partially care for themselves have trouble gripping things, due to a lack of dexterity and strength in the fingers caused by arthritis or other disease, age, etc. For such people, bathing or washing any surface can become extremely difficult and painful. Most conventional sponges are difficult for such persons to grip, particularly because they require the fingers to be bent a substantial amount.

Devices have been proposed in the past to alleviate such problems by providing means for attaching a sponge to the hand. Some such devices have loops, straps or other fasteners to attach to the hand. However, such devices are difficult to use, relatively expensive to make, and otherwise unsatisfactory.

Another problem with prior bath sponges is that often they are so bulky that they are hard to use in washing body crevices, such as between the toes, etc. The bulk of many prior sponges also makes it difficult to apply strong scrubbing pressure to an area which needs it, especially when the user has weakened hands.

Accordingly, it is an object of this invention to provide a washing device or sponge which is relatively easy and comfortable to grip; one which can be firmly held with minimal bending of the fingers, and without bothersome straps or other fasteners.

It is another object to provide such a device which is made of a foam material which is mildly abrasive, and relatively wear-and tear-resistant.

It is another object of the invention to provide such a sponge which can be used to scrub with substantial local scrubbing pressure, despite the usual cushioning effect of the sponge.

Another object is to provide such a sponge and a method of making it which are simple to use and whose cost is reasonable.

The foregoing objects are met by the provision of a sponge having a rounded back with a curvature similar to that of a slightly cupped hand. The rounded back allows the sponge to be gripped with minimal bending of the fingers. The shape of the sponge preferably is that of a flattened hemisphere which has been narrowed to a blunt point on one side. Preferably, the outer edge of the sponge has a long rounded portion and two substantially straight portions connected by a rounded corner of relatively small radius.

A finger notch preferably is provided in one edge to aid gripping the sponge.

The sponge also has a flap which is thinner than the remainder of the sponge. The flap permits one to apply greater pressure during scrubbing than is practical with the thicker material of the sponge, and is easier to press or fit into small crevices to wash them.

The flap preferably is located at the end of the finger notch to facilitate manipulation of the flap with one finger.

In one embodiment, the device is used as a bathing sponge. The foam it is made of is soft, yet mildly abrasive to allow for effective, stimulating scrubbing, and firm enough to retain its shape when rubbed against the skin.

One finger, preferably the index finger, is placed in the finger notch. This gives a firmer grip on and control of the sponge, as well as better scrubbing power and precision. When pressure is exerted by the finger tip on the flap, a relatively small protrusion of sponge material is formed which can be used to wash body crevices such as between the toes, in and behind the ears, etc. Moreover, the general shape of the sponge allows for washing body crevices, since a wedge is formed all along the edge where the rounded back meets the flat underside.

The sponge body is made by compressing a sheet of foam material against a plate with a hole or cavity of the proper shape, and severing the portion which protrudes into the cavity or through the hole. The finger notch and flap are formed, respectively, by milling and cutting.

In another embodiment, the sponge may be used for all-purpose washing, such as washing dishes, wiping countertops, or washing cars. Here, the sponge is shaped the same, fits in the hand the same, and operates in the same way, except that the sponge, or at least its flat underside, is made of a stiffer, more abrasive foam to facilitate heavy-duty scrubbing.

In the drawings

FIG. 6 is a front elevation view of the sponge shown in FIG. 1.

Figure 1:
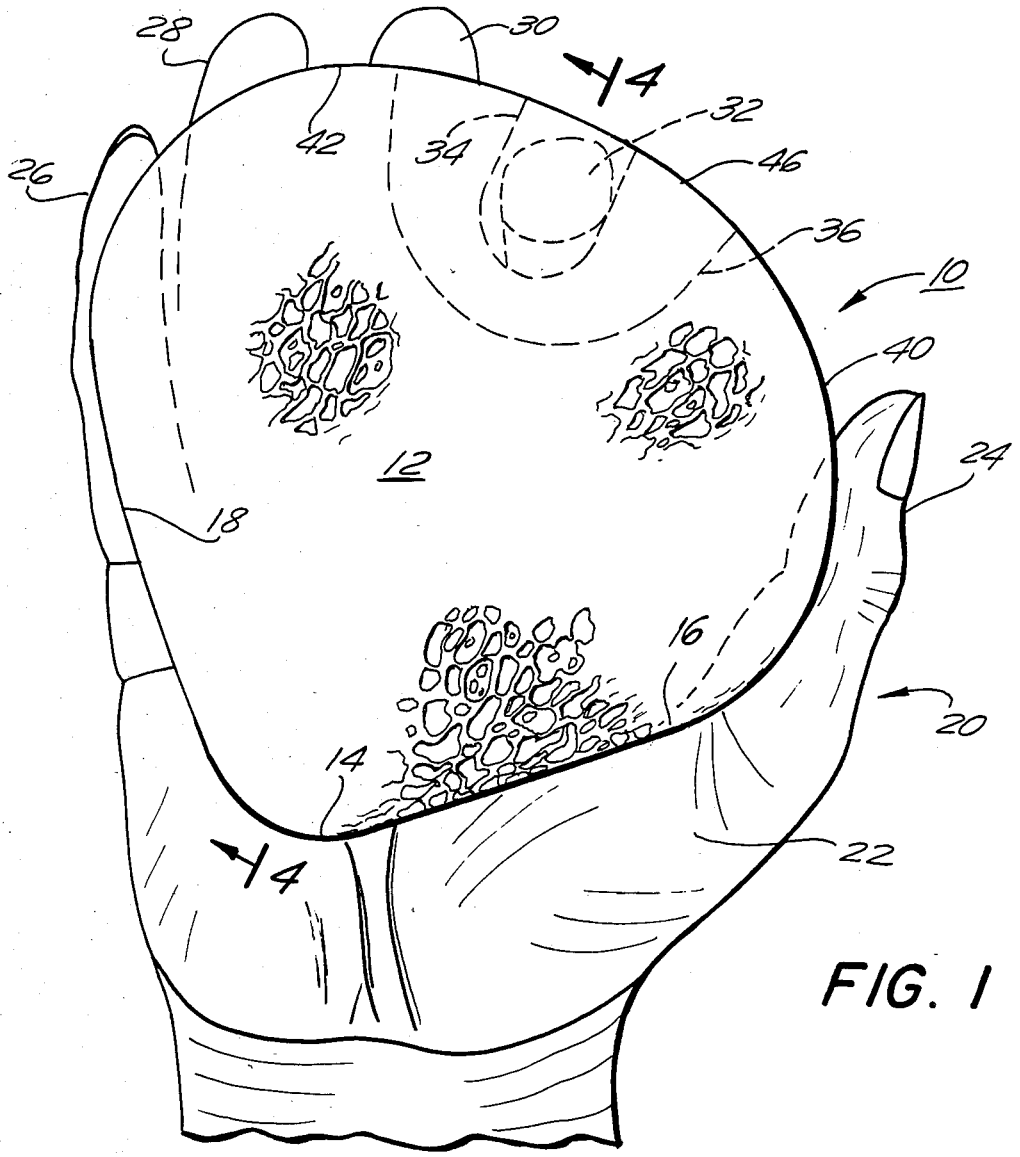
FIG. 1 is a bottom plan view of the preferred embodiment of the sponge as held in the hand, with the flat scrubbing surface showing.

FIG. 1 shows the sponge 10 constructed in accordance with the present invention, as it is held in the hand 20 for use in washing. The parts of the hand 20 shown are the heel 22, the side 44, the thumb 24, the index finger 32, and the middle, fourth, and fifth fingers, 30, 28, and 26 respectively.

The sponge 10 is shown with its flat underside or washing surface 12 showing. The sponge has substantially straight edges 16 and 18, with the edge 16 being fitted against the heel of the hand 22, and straight edge 18 approximately parallel to the edge 44 of the hand. The straight edges 16 and 18 are connected by a rounded corner 14 of relatively small radius, which gives the sponge a relatively pointed end.

The sponge 10 shown in FIG. 1 has a finger notch 34 (shown in dashed outline), with the index finger 32 inserted into it. As it is shown in FIG. 2, the sponge 10 has a slit 36 which forms a flap 38 at one end of the notch 34.

The sponge 10 has a rounded back shaped to fit into the hand 20 when it is slightly cupped, as shown in FIG. 1. Preferably, the index finger is inserted in the notch 34 to give a better grip on the sponge. However, the notch is not essential for this purpose, since the shape of the sponge allows it to be gripped relatively firmly without extensive bending of any of the fingers. This advantageously allows persons with arthritic, or weakened, or otherwise partially disabled hands to hold the sponge sufficiently securely for washing.

The shape of the sponge gives it other advantages. The small pointed end 14 of the sponge fits into some crevices to facilitate washing them.

Figure 2:
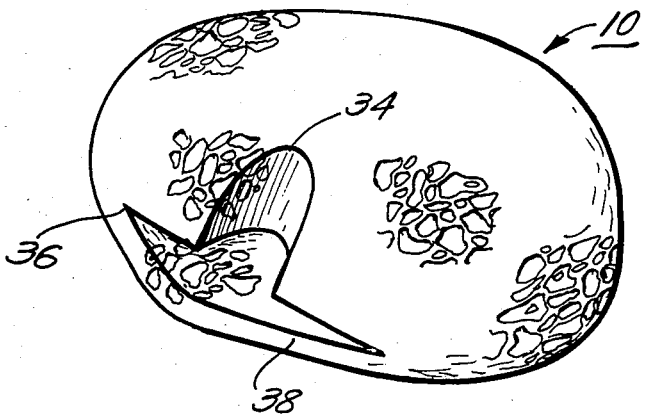
FIG. 2 is a front perspective view of the sponge of FIG. 1, showing the finger notch and the flap.

By pressing on the flap 38 with the finger in the notch 34, the flap bulges outwardly in the shape shown in FIG. 2. Thus, an even narrower projection of the sponge material is formed for washing in crevices even smaller than those which can be reached by the small end 14.

The flap 38 has another advantage. The thickness of the flap is substantially less than that of the remainder of the sponge. Since there is much less sponge material between the finger pressing against the flap and the surface being scrubbed than there would be if one were pressing on the remainder of the sponge, more scrubbing pressure can be brought to bear on the surface being scrubbed. Thus, the flap 38 facilitates both the scrubbing of relatively small crevices and the application of relatively intense scrubbing pressure.

The location of the flap 38 at the end of the notch 34 is very convenient because that is where the index finger usually is located to improve the grip of the hand on the sponge.

Figure 3:
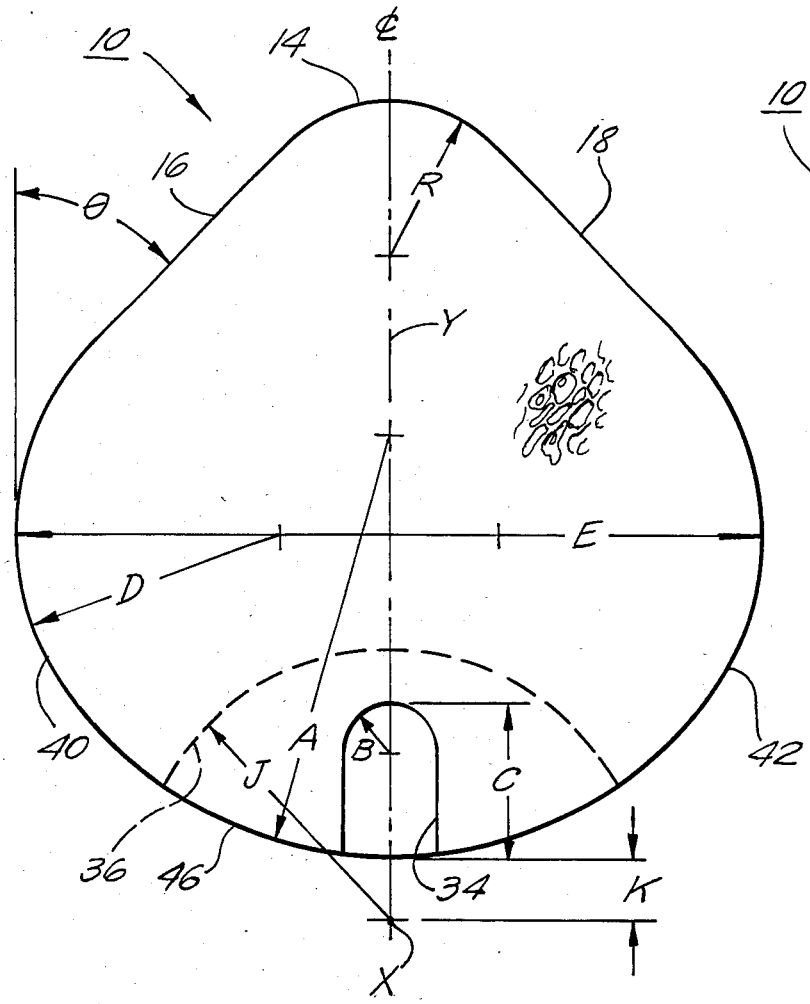
FIG. 3 is a top plan view of the sponge of FIG. 1.

FIG. 3 shows the relative dimensions of the preferred embodiment of the sponge 10. The radius R of rounded corner 14 is used as the reference radius against which all other dimensions are compared. The rounded edge comprising the upper portion of FIG. 3 includes portions 40, 42, and 46. Portions 40 and 42 are the curved portions between the ends of the slit 36 and the straight sections 16 and 18, respectively. The radius D of both curved portions 40 and 42 is equal to 1.75 R. These two curved portions smoothly join with the curved portion 46, which is the top portion of the edge of the sponge between the ends of the slit 36. The radius A of portion 46 is equal to 2.75 R. The combination of these curves of different radii gives the edge an ellipical shape.

The inner edge of the slit 36 is a circular curve with a radius which is equal to 1.75 R from a point X whose distance K from the top of the sponge, at its vertical centerline, equals $\frac{3}{8}$ R. The radius B of the semi-cylindrical inner portion of the finger notch 34 is equal to 5/16 R, and its depth C is equal to R.

Figure 4:
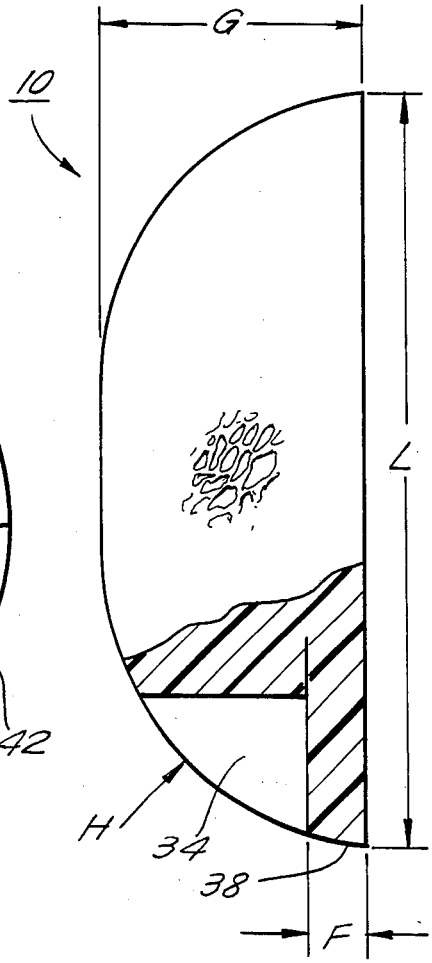
FIG. 4 is a partially cross-sectional side elevation view, with the cross-section being taken along line 4—4 of FIG. 1.
Figure 5:
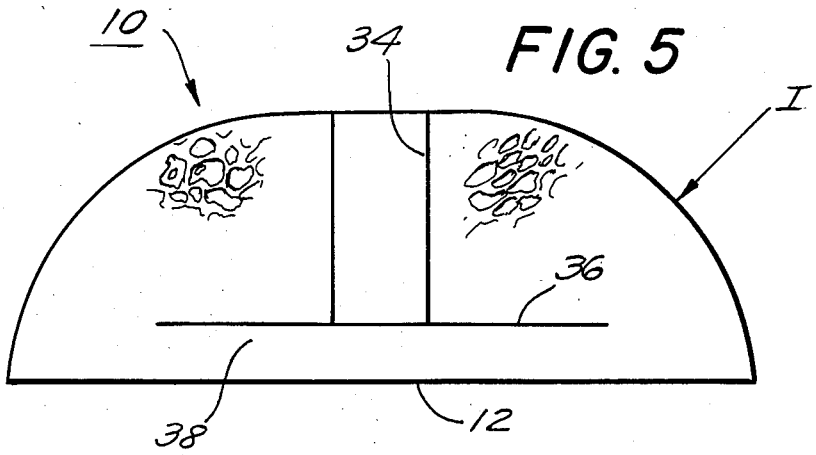

The radii H and I of the rounded back portion of the sponge are equal to 2 R, as shown in FIGS. 4 and 5.

The sponge 10 is symmetrical about the vertical center line Y. The sponge 10 is also of approximately equal length and width, as width E is approximately equal to the length L of the sponge at the center line Y. The angle $\theta$ between each of the sides 16 and 18 and vertical is approximately 45 degrees.

The sponge 10 comes in different sizes to fit hands of different sizes, so there are no set values for lengths E, F and G; however, it is preferred that these dimensions remain constant relative to one another. The thickness G is approximately $\frac{1}{3}$ the width L of the sponge. The thickness F of the flap 38 is approximately 1/5 the thickness G, as can be seen best in FIG. 4.

FIGS. 4 and 5 show the flattened, substantially hemispherical shape of the sponge, and FIG. 3 shows that the end 14 is narrowed to a relatively pointed oblong shape.

Preferably, the ratio of the maximum width E to the maximum thickness G of the sponge is approximately 3, and preferably should be between 2.5 and 3.5. This helps to assure that the sponge can be held without too much finger pressure.

The material of which the sponge 10 preferably is made is a fully-reticulated polyurethane foam having a density of 1.8 pounds per cubic foot, and a cell count of 40 to 50 cells per square inch. Partially-reticulated foam also can be used. The material is mildly abrasive so that it gives the skin a healthy "tingling" feeling when used as a bath sponge. By scrubbing away outer cornified epithelial cells, mitosis in the germinative layer is stimulated and cell turnover is increased. This gives a fresher and more youthful appearance to the skin.

The sponge body preferably is formed by forming in a plate one or more holes or cavities whose edges are shaped like the outline of the sponge as show in FIG. 3, compressing a sheet of polyurethane foam against the plate so that it bulges into the cavity or the hole, and slicing off the foam portion which protrudes into the cavity or through the hole. The thickness of the foam sheet need be only slightly greater than the thickness G of the finished sponge 10. The cut 36 to form the flap 38 is formed by a rotary saw or knife. The finger hole 34 is formed by the use of a milling cutter for plastic foam. Other forming methods also can be used.

It can be seen that the washing device or sponge which has been described meets the objects of the invention described above. The sponge has a shape such that it fits the contours of a slightly cupped hand. Hence, it can be held firmly with minimal bending of the fingers. This allows for a grip which is comfortable and very helpful to the elderly or others with limited use of their hands. Moreover, this is achieved without the use of bothersome straps or other fastening means. The finger-notch similarly aids gripping and controlling of the sponge.

The sponge is comprised of reticulated polyurethane foam, a good material for washing. The texture and coarseness of the foam can be varied for different washing purposes. Also, the foam is relatively tear-resistant, providing a relatively long-lasting product. The sponge can be made at a reasonable cost.

The flap on the sponge greatly facilitates scrubbing in hard-to-reach crevices, and also allows the application of relatively large scrubbing pressures to small surface areas.

The method of making the sponge is relatively fast and cost-effective. It minimized the amount of expensive shaping which otherwise would be required to produce the relatively complex curvatures of the sponge body.

The above description of the invention is intended to be illustrative and not limiting. Various changes or modifications in the embodiments described may occur to those skilled in the art and these can be made without departing from the spirit or scope of the invention.

I claim:

1. A sponge, said sponge having a washing surface and a rounded back surface shaped to fit into a slightly cupped hand and to be held in said hand with a minimal bending of the fingers of said hand, said sponge having a finger-receiving notch in one edge, which sponge has a flap of sponge material which is positioned adjacent said finger notch so that a finger in said notch can be used to press on the flap.

2. A washing sponge made of open cell resilient flexible material, having a flat washing surface with a rounded back shaped and sized to fit into a slightly cupped hand with minimal bending of the fingers, said sponge having, in a plan view, an outline which is generally circular at one end, pointed at the other, with relatively straight edges joining the pointed and circular ends, the maximum width of said sponge being from about 2.5 to 3.5 times its maximum thickness, said sponge including a notch shaped and sized to receive a human finger therein, said notch being formed in said rounded back at the edge of said generally circular end of said sponge, said notch ending at a certain distance from said washing surface, thus forming a flap of a thickness substantially less than the maximum thickness of said sponge.

3. A sponge as in claim 2 in which said flap extends beyond the confines of said notch, and is formed by a generally circular cut in a plane parallel to the plane of said washing surface.

4. A flexible, absorptive sponge in the general shape of an oblong flattened hemisphere for washing surfaces, said sponge comprising a sponge body of a size to fit into the human hand, said sponge having a top surface, a bottom surface, and a side surface, said side surface having a finger-receiving notch in it to facilitate gripping of said sponge, said sponge including a flap of a thickness substantially less than that of the rest of said sponge body, and means for permitting direct access to said flap by a portion of a hand for use in hard scrubbing.

5. A flexible, absorptive sponge for washing surfaces, said sponge comprising a sponge body of a size to fit into the human hand, said sponge having a top surface, a bottom surface, and a side surface, said side surface having a finger-receiving notch in it to facilitate gripping of said sponge, said sponge including a flap of a thickness substantially less than that of the rest of said sponge body, and means for permitting direct access to said flap by a portion of a hand for use in hard scrubbing, in which said flap is located closedly adjacent said finger-receiving notch so that said flap can be engaged by a finger placed in said notch.

6. A method of fabricating a sponge from a body of foam material, said method comprising the steps of providing a plate with at least one recess therein, pressing said body of foam material against said plate so that said foam material bulges into said recess, and severing the portion of said foam which protrudes into said recess from the remainder of said body.

7. A method as in claim 6 in which said recess has an edge shaped like the outside edge of said sponge.

* * * * *